US008152579B2

(12) United States Patent
Carbonel

(10) Patent No.: US 8,152,579 B2
(45) Date of Patent: Apr. 10, 2012

(54) DIRECT-PROPULSION EQUIPMENT WITH AN INTERNAL COMBUSTION ENGINE FOR A BOAT, IN WHICH EQUIPMENT THE ENGINE AND THE PROPELLER CONSTITUTE A UNIT ASSEMBLY CAPABLE OF PIVOTING VERTICALLY AND HORIZONTALLY

(76) Inventor: Claude Carbonel, Marseilles (FR)

( * ) Notice: Subject to any disclaimer, the term of this patent is extended or adjusted under 35 U.S.C. 154(b) by 89 days.

(21) Appl. No.: 12/741,851

(22) PCT Filed: Oct. 27, 2008

(86) PCT No.: PCT/FR2008/001511

§ 371 (c)(1),
(2), (4) Date: May 7, 2010

(87) PCT Pub. No.: WO2009/092883

PCT Pub. Date: Jul. 30, 2009

(65) Prior Publication Data

US 2010/0267297 A1 Oct. 21, 2010

(30) Foreign Application Priority Data

Nov. 7, 2007 (FR) ..... 07 07814

(51) Int. Cl.
*B63H 5/125* (2006.01)

(52) U.S. Cl. ..... 440/111

(58) Field of Classification Search ..... 440/53, 440/54, 111
See application file for complete search history.

(56) References Cited

U.S. PATENT DOCUMENTS 3,057,320 A 10/1962 Daniels
3,382,839 A 5/1968 Kiekhaefer

FOREIGN PATENT DOCUMENTS

EP 296797 A1 * 12/1988

* cited by examiner

*Primary Examiner* — Edwin Swinehart
(74) *Attorney, Agent, or Firm* — Collen IP; Donald J. Ranft

(57) ABSTRACT

The subject of the present invention is direct-propulsion equipment with an internal combustion engine for a boat, in which the engine and the propeller constitute a unit assembly capable of pivoting vertically and horizontally. It consists of a cradle (3) supporting the engine (2), that can pivot near the transom (16) of the boat (1) about a horizontal pivot axis (A2), the engine being coupled to a drive shaft (4) bearing the propeller (5) at its end, this entity being rendered non-deformable by virtue of two semi-circular lateral arms (6) centered on the pivot axis (A2) and each connected by a rear arm (7) to a chair (8) supporting the drive shaft and by a lateral arm (9) to the cradle (3) in order to cross-brace the assembly which is connected to an inverted bracket (15) attached to the inside of the transom (16) and allowing said assembly to rotate about a substantially vertical axis (A1). The invention relates to the industrial and commercial field of boat propulsion unit manufacture and distribution.

11 Claims, 3 Drawing Sheets

Figure 3:
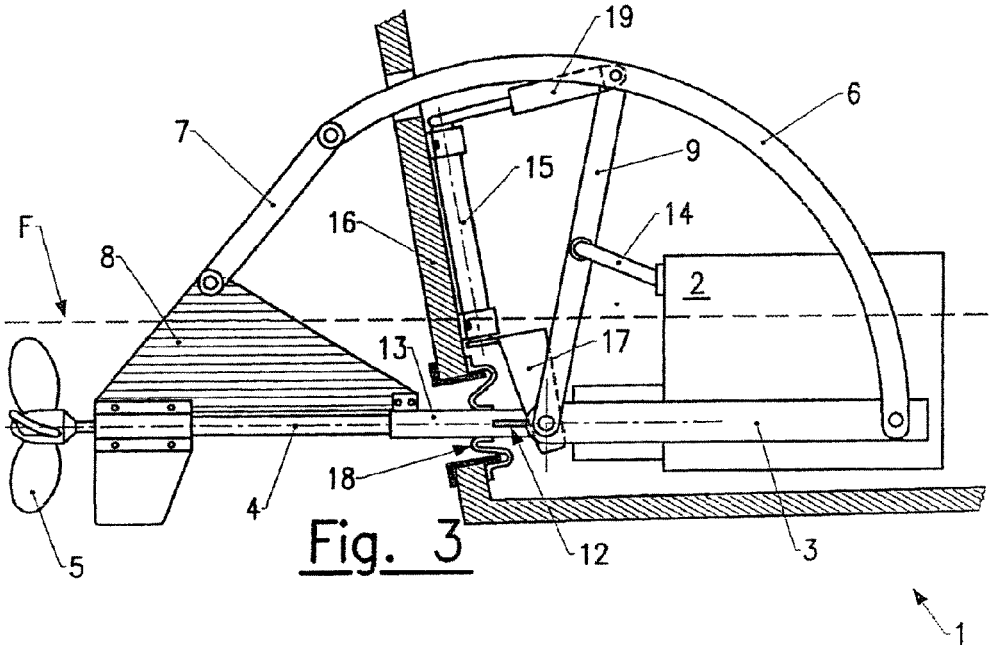

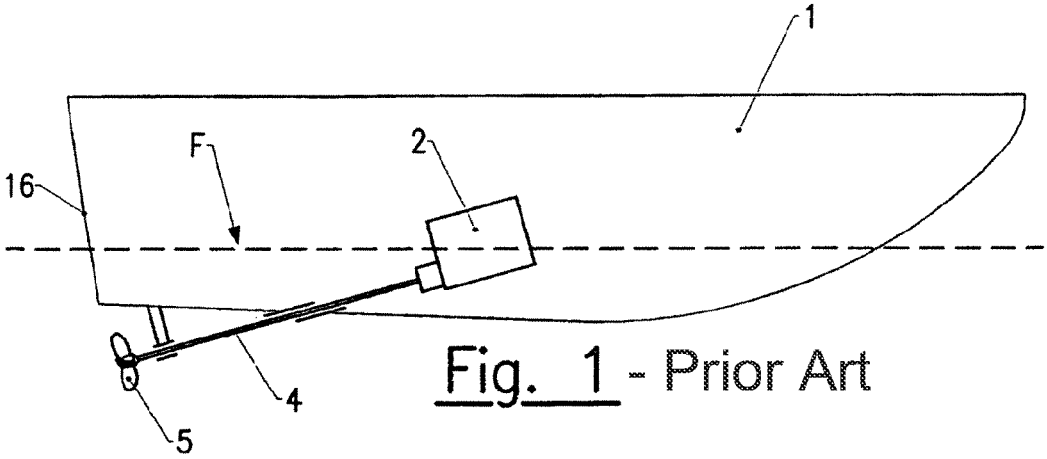
Fig. 1 - Prior Art
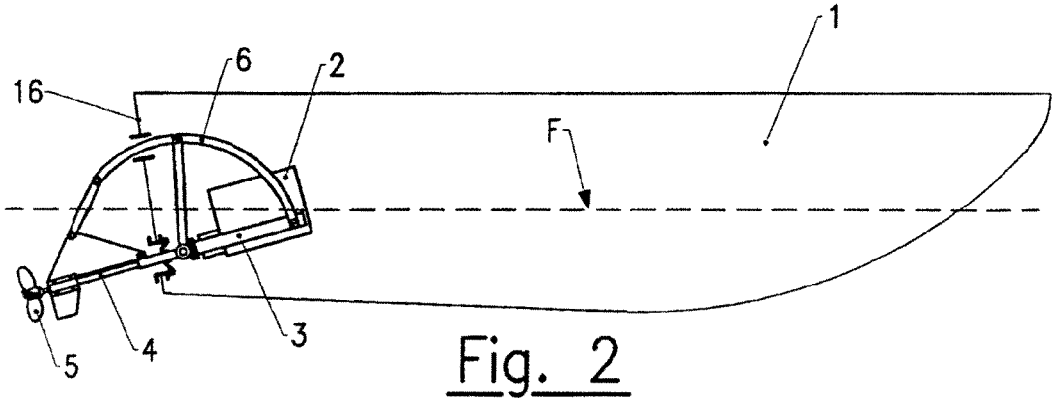
Fig. 2

DIRECT-PROPULSION EQUIPMENT WITH AN INTERNAL COMBUSTION ENGINE FOR A BOAT, IN WHICH EQUIPMENT THE ENGINE AND THE PROPELLER CONSTITUTE A UNIT ASSEMBLY CAPABLE OF PIVOTING VERTICALLY AND HORIZONTALLY

The present invention relates to a direct propulsion apparatus having an inboard engine for a boat, in which the engine and the propeller constitute a unit assembly capable of pivoting vertically and horizontally.

It relates generally to the industrial and commercial field of manufacturing and distributing propulsion units for boats.

Direct propulsion systems formed by a cradle mounted on a cardan joint and supporting the engine, the drive line and the propeller are known and used in particular in Asia for the propulsion of boats (long tail boats).

This assembly is placed on the deck, above the waterline, and generally fastened to the top part of the transom. To achieve satisfactory efficiency, the angle of attack of the propeller must be around 10 to 12°, this leading to a ratio of around 1:4 between the height of the engine above the water surface and the length of the propeller shaft. For an engine height of 1 m, this length is close to 4 m, which is excessive. The result is an assembly which is not rigid, leading to vibrations and danger. However, for Asia and poor countries, the simplicity of construction cancels out drawbacks which are unacceptable in Western countries.

By way of illustration of this type of embodiment, mention may be made of patents FR 1 024 705 (Julio Kovats) and CH 271 296 (Charles Pugh).

In order to reduce the height of the engine above the waterline, the propulsion assembly may be arranged such that the propeller shaft passes through the transom.

By way of example, U.S. Pat. No. 3,382,839 (Carl Kiekhaefer et al.) describes a propulsion unit comprising an engine connected rigidly to the propeller through an opening in the transom of a boat. The assembly is mounted on a ball and socket joint fastened to this transom and making it possible to raise or lower the propeller, the rotational axis of which is approximately horizontal. The support for this propeller is mounted at the end of an inclined cylindrical tube through which the driveshaft passes, the axial rotation of this tube making it possible to orient the propeller in order to steer the boat.

The ball and socket joint, and also the angular transmission device necessitated by the fact that the propeller axis is not in line with the driveshaft, are complicated and expensive elements.

Another patent, filed by the inventor Daniels (U.S. Pat. No. 3,057,320, filed in 1960), demonstrates an assembly passing through the transom, having an engine located in the well, this rigid assembly rocking ahead of the center of gravity in order to change the height of the propeller and running along a rail in order to change the orientation of the propeller to steer the boat. This patent was not industrially applicable because the assembly vibrated too much and the propeller shaft, which was not divided into triangles, became dangerous.

The objective of the device according to the present invention is to remedy the abovementioned problems. Specifically, it makes it possible to obtain a simple engine assembly that is easy to maintain and has a very low cost in order to use highly efficient, environmental or other internal combustion engines.

It also enables a boat having an inboard engine to maneuver like one with an outboard, with all the advantages of the latter and without its drawbacks.

It consists of an assembly comprising a cradle supporting the engine and rocking/pivoting at a point close to the transom in order to modify the vertical inclination of the propeller shaft, the engine being coupled to a drive line in line with its rotational axis and bearing the propeller at the end, the whole assembly forming a short assembly made rigid by virtue of two semicircular side elements centered on the rocking axis, which intersects the axis of the propeller shaft so as to prevent destabilizing thrust, each of these semicircular elements being connected by a rear arm to a bracket supporting the propeller shaft and by a side arm to the supporting cradle in order to divide the assembly into triangles to render it nondeformable. This nondeformable assembly is connected to an inverted brace fastened inside the transom and enabling the propeller to be oriented so as to steer the boat.

Figure 4:
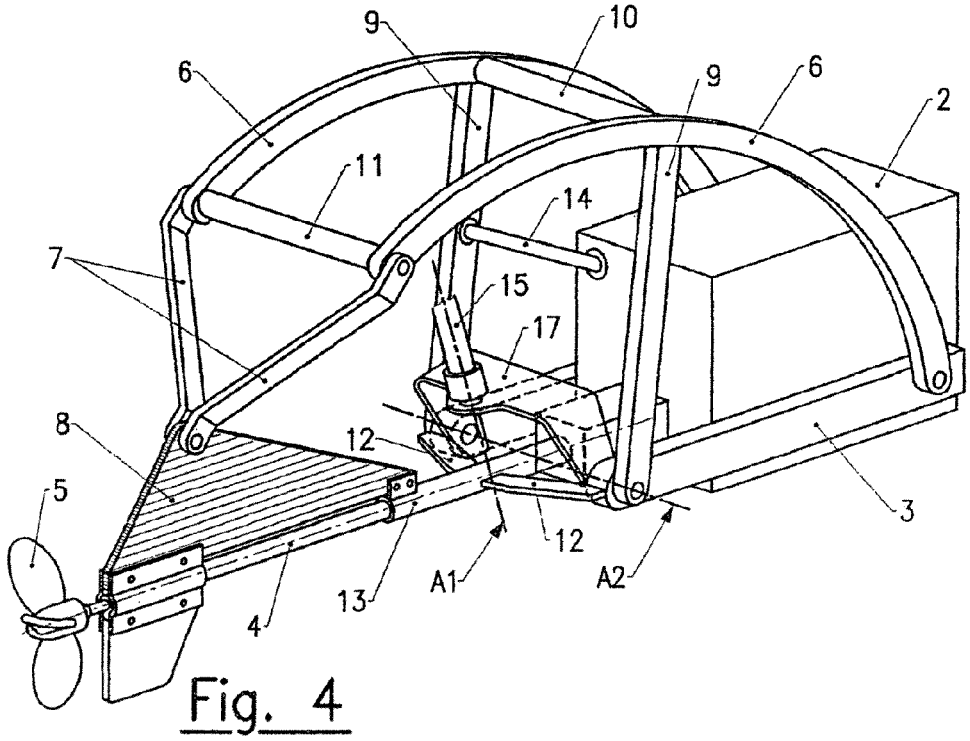
Figure 5:
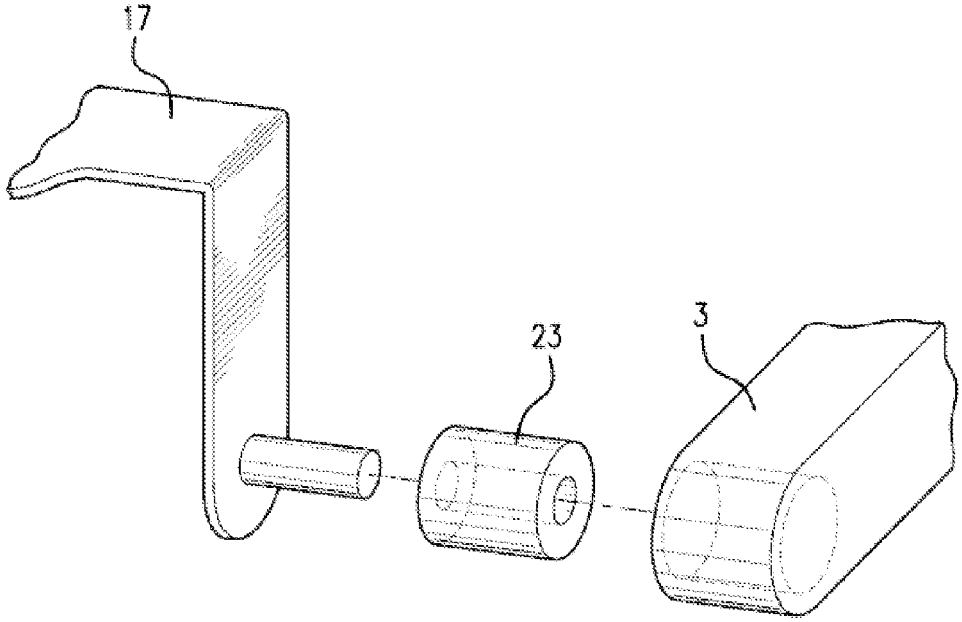
Figure 6:
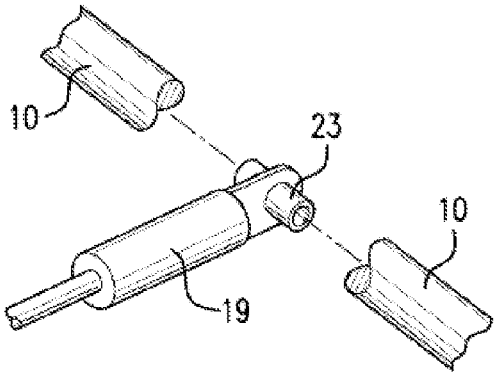
Figure 7:
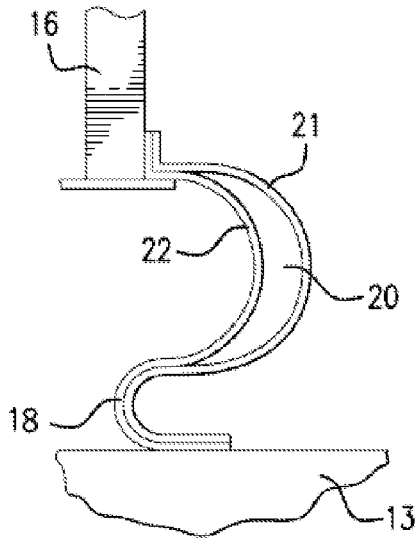

In the appended drawings, given by way of nonlimiting example of an embodiment in accordance with the present application:

FIG. 1 schematically represents the most common arrangement of the engine, of the propeller and of its driveshaft in a motor boat having an inboard engine, FIG. 2 shows, under the same conditions, the arrangement of these members in accordance with the invention, FIG. 3 is a partial vertical longitudinal section through the hull of a boat equipped with the propulsion assembly according to the invention, FIG. 4 is an axonometric perspective view of this propulsion assembly, FIG. 5 depicts a dampening ring between the supporting cradle 3 and the support 17, FIG. 6 depicts a dampening ring between the actuator 19 and the top cross member (10), and FIG. 7 depicts a twin mounted bellows.

FIG. 1 shows a conventional motor boat 1 having a fixed inboard engine 2 and a driveshaft 4 of the propeller 5 passing through the bottom of the hull. As a result, the propeller is located just below the bottom of the boat and this does not allow it to be used in shallow waters.

The device in FIGS. 2 to 4 is a rigid propulsion assembly consisting of an engine 2 secured to a supporting cradle 3 and coupled to a drive line 4 in line with its rotational axis and bearing the propeller 5 at the end.

The rigidity of the assembly is ensured by means of a structure formed by two semicircular side arms 6, of which the front ends are fastened to the supporting cradle 3 and the other ends are each connected by a rear arm 7 to a bracket 8 supporting the propeller shaft 4, two side arms 9 connecting the upper part of the semicircular elements 6 to the front of the supporting cradle 3, the semicircular arms 6 being secured by two horizontal crossmembers, a top crossmember 10 connecting the two junction points with the side arms 9 and a rear crossmember 11 connecting the two junction points with the rear arms 7.

Two reinforcing bars 12 are each fastened at one end to a rear side end of the supporting cradle 3 and at the other end to a tube 13 through which the driveshaft 4 of the propeller 5 passes, this tube being secured to the engine 2 and to the bracket 8.

This structure is arranged such that the assembly can be divided into triangles to render it nondeformable.

This division into triangles is completed by a linking bar 14 fastened at one end to the engine 2 and at the other end to one of the side arms 9.

The propulsion assembly is supported by an inverted brace 15 fastened inside the transom 16 of the boat and enabling said assembly to rotate about an approximately vertical axis A1 in order to orient the propeller 5 so as to be able to steer the boat 1.

Fastening to the brace 15 is carried out by means of an inverted U-shaped support 17 articulated on the two rear side ends of the supporting cradle 3 and arranged such that the propulsion assembly can rock close to the transom 16 about a horizontal rocking axis A2 so as to be able to change the height of the propeller 5 by modifying the vertical inclination of the driveshaft 4. The rocking axis A2 passes through the center of the circular arcs formed by the semicircular arms 6 and intersects the axis of the driveshaft 4 of the propeller so as to prevent destabilizing thrust.

The two semicircular arms 6 pass through the transom via openings located above the waterline F, and this limits sealing problems.

The driveshaft 4 of the propeller 5 passes through the transom, below the waterline F, in a lubricated sealed tube 13 fastened to the bracket 8 and to the supporting cradle 3 and enabling the moving parts to be cooled. Sealing is provided by virtue of an S-shaped flexible bellows 18 of which the collars for clamping to the tube 13 are inside the boat so as to protect them from electrolysis.

The bellows 18 may be twin mounted with a reserve of oil (20) between the inner (21) and outer (22) elements in order to generate an alarm in the event of piercing.

An actuator 19, a worm drive or any other lifting means could connect the brace to the supporting structure of the propulsion assembly in order to rock it up or down.

The articulations between the support 17 and the cradle 3, and also the end of the actuator 19 or lifting means secured to the supporting structure, will advantageously be equipped with damping rings (22) of the silent block type in order to prevent vibrations being transmitted to the boat.

In the stopped position, the engine 2 will be at the bottom of the well, providing maximum stability by lowering the center of gravity. The propeller will thus be closest to the waterline and could easily be changed. In addition, the boat could be mounted on a trailer and could approach shallow waters.

An actuator, or any other means such as a cable, will be connected to a maneuvering arm on the brace in order to steer.

The positions of the various constituent elements give the subject matter of the invention the maximum number of useful effects which have not hitherto been achieved by similar devices.

The invention claimed is:

1. A direct propulsion apparatus for an inboard engine in a boat, in which the engine and a propeller constitute a unit assembly capable of pivoting vertically and horizontally comprising: a cradle (3) supporting the engine (2) and pivoting close to a transom (16) of the boat (1) about a horizontal axis (A2); the engine being coupled to a driveshaft (4) in line with its rotational axis and bearing the propeller (5); a whole assembly being made rigid by virtue of two semicircular side arms (6) centered on the axis (A2); each of these semicircular arms being connected by a rear arm (7) to a bracket (8) supporting said driveshaft and by a side arm (9) to the supporting cradle; the assembly being connected to an inverted brace (15) fastened inside the transom (16) and enabling said assembly to rotate about an approximately vertical axis (A1) in order to orient the propeller (5) to steer the boat (1).

2. The propulsion apparatus as claimed in claim 1, further comprising: a linking bar (14) fastened at one end to the engine (2) and at the other end to one of the side arms (9).

3. The propulsion apparatus as claimed in claim 2 further comprising: two reinforcing bars (12) each fastened at one end to a rear side end of the supporting cradle (3) and at the other end to a tube (13) through which the driveshaft (4) of the propeller (5) passes, said tube being secured to the engine (2) and to the bracket (8).

4. The propulsion apparatus as claimed in claim 3 wherein the semicircular arms (6) are secured by two horizontal crossmembers, a top crossmember (10) connecting the two junction points with the side arms (9) and a rear crossmember (11) connecting the two junction points with the rear arms (7).

5. The propulsion apparatus as claimed in claim 4 wherein the horizontal rocking axis (A2) intersects the axis of the driveshaft (4) so as to prevent destabilizing thrust.

6. The propulsion apparatus as claimed in claim 5 wherein the driveshaft (4) of the propeller (5) passes through the transom (16), below waterline (F), in a lubricated sealed tube (13) fastened to the bracket (8) and to the supporting cradle (3), with sealing provided by an S-shaped flexible bellows (18) of which collars for clamping to the tube (13) are inside the boat.

7. The propulsion apparatus as claimed in claim 6, characterized in that the bellows (18) is twin mounted with a reserve of oil (20) between inner (21) and outer (22) elements.

8. The propulsion apparatus as claimed in claim 6 in which the assembly is fastened to the brace (15) by means of an inverted U-shaped support (17) articulated one two rear side ends of the supporting cradle (3) and arranged such that the propulsion assembly can pivot close to the transom (16) about the horizontal rocking axis (A2).

9. The propulsion apparatus as claimed in claim 8 in which the assembly is connected to the brace (15) by an actuator (19) enabling the assembly to pivot up or down.

10. The propulsion apparatus as claimed in claim 9, wherein the articulations between the support (17) and the cradle (3) and also at the end of the actuator (19) secured to the supporting structure are equipped with damping rings (23) of the silent block type in order to prevent vibrations being transmitted to the boat.

11. The propulsion apparatus as claimed in claim 9 wherein the brace (15) is equipped with a maneuvering arm connected to an actuator, for pivoting the propulsion assembly about the axis (A1) in order to steer the boat.

* * * * *